US009206771B2

(12) United States Patent
Williams

(10) Patent No.: US 9,206,771 B2
(45) Date of Patent: Dec. 8, 2015

(54) CANISTER PURGE VALVE WITH MODULAR LOWER BODY HAVING INTEGRAL CHECK VALVES

(75) Inventor: Benjamin Dominick Manton Williams, Chatham (CA)

(73) Assignee: Continental Automotive Systems, Inc., Auburn Hills, MI (US)

( * ) Notice: Subject to any disclaimer, the term of this patent is extended or adjusted under 35 U.S.C. 154(b) by 835 days.

(21) Appl. No.: 13/524,090

(22) Filed: Jun. 15, 2012

(65) Prior Publication Data

US 2012/0318243 A1 Dec. 20, 2012

Related U.S. Application Data

(60) Provisional application No. 61/497,832, filed on Jun. 16, 2011.

(51) Int. Cl.
*F02M 25/08* (2006.01)

(52) U.S. Cl.
CPC ..... *F02M 25/0836* (2013.01); *F02M 25/08* (2013.01); *F02M 2025/0845* (2013.01); *Y10T 137/0491* (2015.04); *Y10T 137/7879* (2015.04)

(58) Field of Classification Search
CPC ..... F02M 25/08; F02M 2025/0845
USPC ..... 123/516, 518–520
See application file for complete search history.

(56) References Cited

U.S. PATENT DOCUMENTS

| | | | | |
|---|---|---|---|---|
| 6,253,789 | B1 | 7/2001 | Krimmer et al. | |
| 7,373,930 | B1 * | 5/2008 | Hadre | 123/520 |
| 2002/0096153 | A1 * | 7/2002 | Balsdon et al. | 123/520 |
| 2004/0025851 | A1 | 2/2004 | Krimmer et al. | |
| 2008/0223343 | A1 * | 9/2008 | Ammermann | 123/520 |
| 2010/0139625 | A1 | 6/2010 | Vulkan | |
| 2010/0319789 | A1 | 12/2010 | Erdmann | |
| 2012/0318244 | A1 * | 12/2012 | Williams | 123/520 |
| 2013/0019844 | A1 * | 1/2013 | Kulkarni et al. | 123/520 |
| 2013/0152904 | A1 * | 6/2013 | Balsdon et al. | 123/518 |
| 2014/0311602 | A1 * | 10/2014 | Jefford et al. | 137/899 |
| 2014/0326337 | A1 * | 11/2014 | Jefford et al. | 137/487.5 |

FOREIGN PATENT DOCUMENTS

| | | | |
|---|---|---|---|
| DE | 4225993 | C1 | 1/1994 |
| DE | 19839476 | A1 | 3/2000 |
| DE | 10236387 | A1 | 2/2004 |
| DE | 102009024697 | A1 | 12/2010 |

OTHER PUBLICATIONS

The International Search Report and the Written Opinion of the International Searching Authority. PCT/US2012/024612.

* cited by examiner

*Primary Examiner* — Thomas Moulis

(57) ABSTRACT

A canister purge valve for a vehicle includes a valve member constructed and arranged to control vapor purge flow from a fuel tank and canister structure to an air intake manifold. A modular body is removably coupled to a housing of the valve member. The body defines an internal volume in communication with the valve member to receive vapor purge flow. The body includes at least one outlet port. A check valve is disposed in the body and is associated with the at least one outlet port so that under certain conditions, the check valve permits vapor purge flow to flow from the volume through the outlet port and, under different conditions, prevents flow into the volume.

12 Claims, 2 Drawing Sheets

CANISTER PURGE VALVE WITH MODULAR LOWER BODY HAVING INTEGRAL CHECK VALVES

CROSS-REFERENCE TO RELATED APPLICATIONS

This application claims priority to Provisional Patent Application No. 61/497,832, filed Jun. 16, 2011. The disclosure of the above application is incorporated herein by reference.

FIELD OF THE INVENTION

This invention relates to a vehicle canister purge system for vehicle engines and, more particularly, to a canister purge valve having a modular body that incorporates at least check valves associated with the outlets of the valve.

BACKGROUND OF THE INVENTION

With normally aspirated engines, fuel vapors are purged from a canister by utilizing the intake manifold's vacuum pressure to draw air through the canister. With turbocharged engines, there is often a positive manifold pressure generated during boost and thus there is no vacuum to draw air through the canister. Therefore, it is necessary to provide means to produce an air moving pressure differential with atmosphere so that air can be drawn from the canister to the intake manifold and be directed to the combustion chamber, thereby purging the fuel vapors by burning.

A venturi tube or nozzle is used to generate a vacuum on a turbocharged vehicle engine by scavenging from the pressure differential across the turbo (14 psi or more) to drive air through the a venturi nozzle from the turbocharger outlet and back into the turbocharger inlet. The high velocity airflow and sonic shock waves in the venturi nozzle generate a pressure lower than atmospheric (vacuum) which is used to draw purge air flow into the scavenged turbo loop.

The purge valve is protected from purge loss during naturally aspirated conditions and from turbo pressures by a check valve located between the venturi nozzle and the purge valve, and another check valve located between the intake manifold and the purge valve. Thus, such an arrangement requires multiple plumbing connections and discrete components that increase cost.

There is a need to provide a compact canister purge valve for an engine, with canister purge valve having a selectable modular body that integrates the appropriate devices such as check valves and other components.

SUMMARY OF THE INVENTION

An object of the invention is to fulfill the need referred to above. In accordance with the principles of the present invention, this objective is achieved by providing a canister purge valve for a vehicle that includes a valve member constructed and arranged to control vapor purge flow from a fuel tank and canister structure to an air intake manifold. A modular body is removably coupled to a housing of the valve member. The body defines an internal volume in communication with the valve member to receive vapor purge flow. The body includes at least one outlet port. A check valve is disposed in the body and is associated with the at least one outlet port so that under certain conditions, the check valve permits vapor purge flow to flow from the volume through the outlet port and, under different conditions, prevents flow into the volume.

In accordance with yet another aspect of the invention, a method of assembling a canister purge valve for a vehicle provides a valve member constructed and arranged to control vapor purge flow from a fuel tank and canister structure to an air intake manifold. The valve member is disposed in a housing. The method selects one modular body, from a plurality of modular bodies, to be coupled to a housing of the valve member. Each modular body defines an internal volume to be in communication with the valve member, when coupled thereto. The volume is constructed and arranged for receiving vapor purge flow that passes the valve member. Each modular body includes at least one outlet port and a check valve, in the modular body, and associated with the at least one outlet port. The method couples, in a removable manner, the selected modular body to the housing of the valve member.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings wherein like numbers indicate like parts, in which.

DETAILED DESCRIPTION OF THE EXEMPLARY EMBODIMENTS

Figure 1:
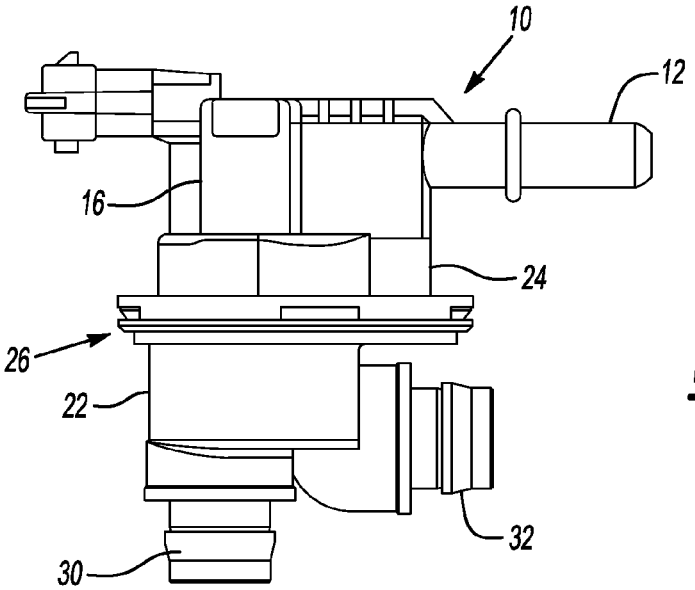
FIG. 1 is a side view of a canister purge valve having a modular lower body defining dual ports, in accordance with a first embodiment of the invention.

With reference to FIG. 1, a canister purge valve for a vehicle, such as one having a turbocharged engine, is shown, generally indicated at 10, in accordance with an embodiment. The valve 10 has an inlet port 12 for connection to vehicle a fuel tank and canister structure (not shown) in the conventional manner. The valve 10 includes a valve member 16 for controlling vapor purge flow from the fuel tank & canister structure and an intake manifold (not shown) and thus to an engine. The valve member 16 may be of any conventional configuration, such as the solenoid type disclosed in U.S. Patent Publication 20080000456 A1, the content of which is hereby incorporated by reference into this specification.

Figure 2:
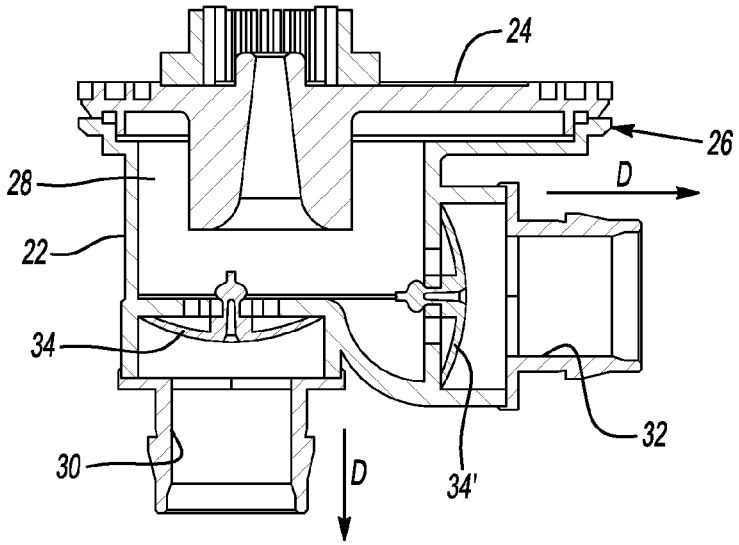
FIG. 2 is a sectional view of the lower body shown coupled to a portion of the canister purge valve of FIG. 1.

The canister purge valve 10 includes a modular lower body 22 coupled to a housing 24 that contains the valve member 16, preferably by use of a snap-fit and O-ring arrangement, generally indicated at 26. The arrangement 26 can include a male member on one part that engages a female member of the other part with an O-ring there-between. Instead of the snap-fit arrangement 26, a weld connection can be used, which eliminates the O-ring. In the embodiment of FIGS. 1 and 2, the body 22 defines an interior volume 28 that communicates with the valve member 16 so as to receive vapor purge flow originating from the fuel tank and canister structure. The body 22 includes at least a first outlet port 30 and a second outlet port 32. In the embodiment of FIGS. 1 and 2, the port 32 is in 90 degree relation with respect to port 30. A one-way check valve is disposed in each port, such that the vapor purge flow in the volume 28 may exit a port in the under certain conditions. In FIG. 2, a check valve 34 is provided in or adjacent to the first port 30 and a check valve 34' is provided in or adjacent to the second port 32. The check valves 34, 34' permit vapor purge flow in the direction of arrow D and prevent flow in the direction opposite direction D.

With the dual outlet ports of the valve 10 of the embodiment, a vacuum generator such as a venturi tube (not shown) can be in fluid communication with the outlet port 30 and with a turbocharger (not shown). Outlet port 32 can be connected to the intake manifold. Thus, if the turbocharger is functioning, the intake manifold is under positive pressure and the check valve 34' associated with the manifold, closes. The vacuum generated the venturi tube pulls the check valve 34 open to draw in vapor purge flow that passes the valve member 16. The purge flow is then directed to the manifold and thus to the engine to be consumed.

In the naturally aspirated condition, the vacuum created at the manifold pulls the check valve 34' open, thus permitting flow to pass from the valve member 16 to the manifold. In addition, the manifold vacuum pulls the check valve 34 shut, diverting all purge flow directly to the manifold to be consumed in the engine.

Figure 3:
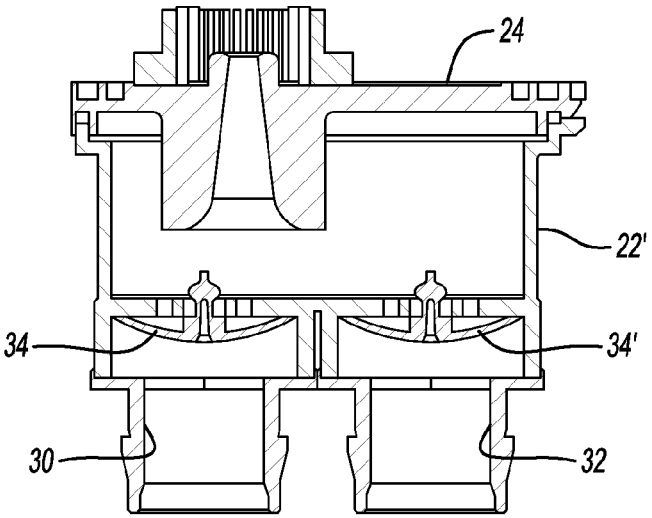
FIG. 3 is a sectional view of a lower body of another embodiment, shown coupled to a portion of a canister purge valve.
Figure 4:
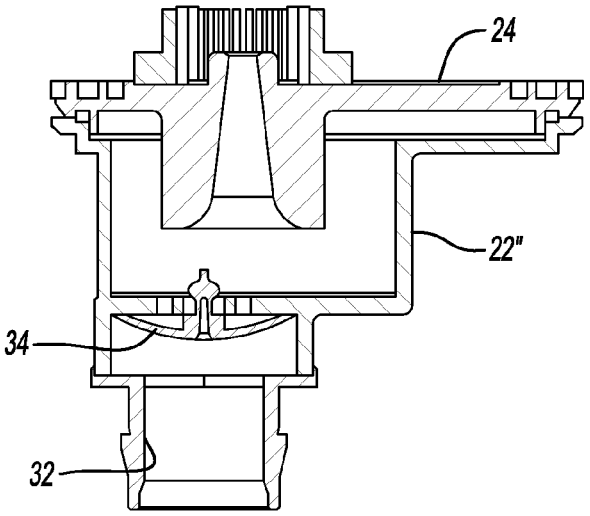
FIG. 4 is a sectional view of the lower body of yet another, shown coupled to a portion of a canister purge valve.
Figure 5:
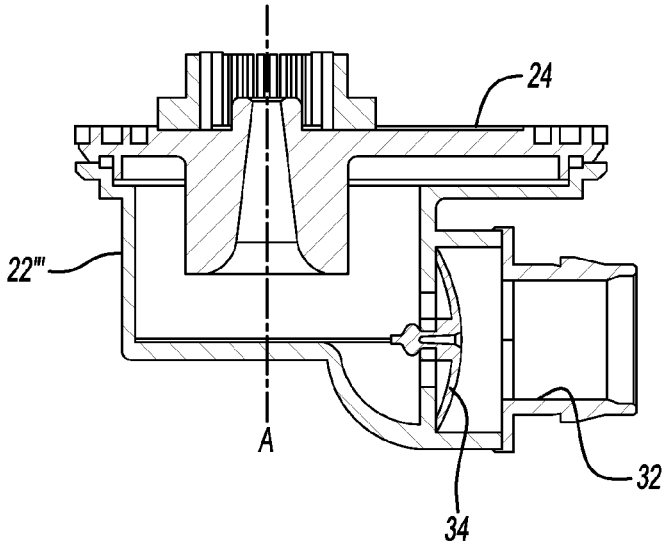
FIG. 5 is a sectional view of a lower body of still another embodiment, shown coupled to a portion of a canister purge valve.

FIG. 3 shows another embodiment of the lower body 22', with the first and second ports 30, 32 in a parallel arrangement. FIG. 4 shows a lower body 22" having only one outlet port 32 and one check valve 34. FIG. 5 shows a lower body 22''' having an outlet port disposed 90 degrees with respect to the longitudinal axis A. Thus, since the lower body 22, 22', 22'''' is modular, a variety of different configurations of the valve 10 is possible based on customer requirements, with the necessary components, such as check valves and even a venturi tube, integral with the valve 10. If desired, lower body 22 can be removed and replaced with lower body 22' or any other lower body selected. Thus, during assembly, one of a plurality of lower bodies can be selected and then assembled to the housing 24 in a removable or fixed manner.

Figure 6:
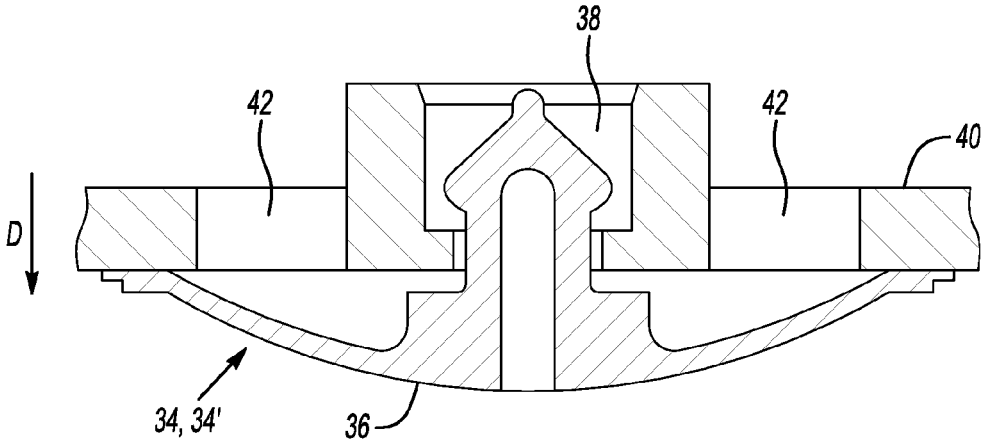
FIG. 6 is a side view of a check valve in accordance with an embodiment.

With reference to FIG. 6, each one-way check valve 34, 34' has a valve member 36 mounted in a free-floating manner to an opening 38 a housing 40 adjacent to an outlet port or in the outlet port. In the embodiment, two openings 42 are provided in the housing 40 adjacent to the valve member 40. It can be appreciated that openings 42 need not be provided if opening 38 is sufficient to provide proper flow through the valve 34, 34'. The valve member 36 is movable due to pressure differences thereon. The valve member 36 is shown in a closed position in FIG. 6, sealed against the housing 40 and preventing air from flowing past the openings 38 and 42. Vacuum pressure, as mentioned above can pull the valve member 36 open (in the direction of arrow D), permitting air flow through the openings 38, 42.

It can be seen that the canister purge valve 10 with modular lower body provides a compact device, since the check valves are integrated in the purge valve. With such construction, fewer plumbing connections are required, which also simplifies assembly and reduce cost. Furthermore, since the lower body is modular, only a plurality of different configurations of the lower body need to be made instead of making a plurality of entire valves 10 of different configurations.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A canister purge valve for a vehicle comprising:

a valve member constructed and arranged to control vapor purge flow from a fuel tank and canister structure to an air intake manifold, a modular body coupled to a housing that is integral with the valve member, the body defining an internal volume in communication with the valve member to receive vapor purge flow, the body including at least one outlet port, and a check valve in the body and associated with the at least one outlet port so that under certain conditions, the check valve permits vapor purge flow to flow from the volume through the outlet port and, under different conditions, prevents flow into the volume, wherein the modular body is removably coupled to the housing so as to be able to be replaced with a different modular body.

2. The valve of claim 1, wherein at least two outlet ports are provided the modular body, with a check valve, disposed in the body, associated with each outlet port.

3. The valve of claim 2, wherein one of the outlet ports is in 90 degree relation with respect to the other outlet port.

4. The valve of claim 2, wherein the outlet ports are disposed in parallel relation.

5. The valve of claim 1, wherein the check valve has an elastomer valve member constructed and arranged to move between open and closed positions based on pressure differences thereon.

6. A method of assembling a canister purge valve for a vehicle, the method comprising:

providing a valve member constructed and arranged to control vapor purge flow from a fuel tank and canister structure to an air intake manifold, the valve member being disposed in a housing, selecting one modular body, from a plurality of modular bodies, to be coupled to a housing of the valve member, each modular body defining an internal volume to be in communication with the valve member, when coupled thereto, the volume being constructed and arranged for receiving vapor purge flow that passes the valve member, each modular body including at least one outlet port and a check valve, in the modular body, and associated with the at least one outlet port, and coupling the selected modular body to the housing of the valve member.

7. The method of claim 6, wherein the coupling step includes coupling, in a removable manner, the selected modular body to the housing.

8. The method of claim 6, wherein the selecting step includes selecting a modular body having a single outlet port, with a check valve associated with the outlet port.

9. The method of claim 6, wherein the selecting step includes selecting a modular body having at least two outlet ports, with a check valve associated with each outlet port.

10. The method of claim 9, wherein the selecting step includes selecting a modular body with one of the outlet ports being in 90 degree relation with respect to the other outlet port.

11. The method of claim 9, wherein the selecting step includes selecting a modular body with the outlet ports being in parallel relation.

12. The valve of claim 1, wherein the modular body is removably coupled to the housing in a snap-fit arrangement.

* * * * *